US005505553A

United States Patent [19]

Saviano et al.

[11] Patent Number: 5,505,553

[45] Date of Patent: Apr. 9, 1996

[54] WRITING AID

[76] Inventors: Jamesen G. Saviano; Paul G. Saviano, both of One Hillcrest Pl., Norwalk, Conn. 06850

[21] Appl. No.: 338,011

[22] Filed: Nov. 14, 1994

[51] Int. Cl.[6] ..... B43K 29/00; B43K 9/00

[52] U.S. Cl. ..... 401/117; 401/100; 434/166

[58] Field of Search ..... 401/91, 100, 117; 434/166

[56] References Cited

U.S. PATENT DOCUMENTS

| | | | |
|---|---|---|---|
| 866,148 | 9/1907 | Levingston | 401/91 |
| 895,511 | 8/1908 | Sturgis | 401/91 |
| 971,797 | 10/1910 | Smythe | 401/91 |
| 1,199,555 | 9/1916 | Jeffries et al. | 401/91 |
| 1,470,724 | 10/1923 | Ginsberg | 401/91 |
| 3,063,419 | 11/1962 | Parker | 401/100 |
| 3,740,159 | 6/1973 | Smagala-Romanoff | 401/91 X |
| 4,601,599 | 7/1986 | Katoh | 401/100 X |
| 4,896,983 | 1/1990 | Im et al. | 401/91 X |

FOREIGN PATENT DOCUMENTS

| | | | |
|---|---|---|---|
| 934235 | 5/1948 | France | 401/117 |
| 951886 | 11/1949 | France | 401/117 |

*Primary Examiner*—Steven A. Bratlie
*Attorney, Agent, or Firm*—Edward R. Hyde

[57] ABSTRACT

A writing aid for use with a writing instrument as a pen or pencil that is to assist the writer in applying proper pressure to the writing surface.

2 Claims, 1 Drawing Sheet

WRITING AID

BACKGROUND OF THE INVENTION

1. Field of the Invention

The present invention relates to a device for improving writing and enhancing penmanship. More particularly it relates to a writing aid that would be attached to a writing instrument such as a pen or pencil to assist the writer in maintaining the proper pressure between the writing instrument tip and the surface upon which he is writing.

A common writing problem among children in particular is that they grip the pen or pencil too tightly and press too hard against the writing surface. This causes broken pencil tips, gouging of the writing surface and fatigue of the hand and fingers of the writer. The consequence of this is that poor penmanship and perhaps almost illegible writing results. Also, the fact of finger and hand fatigue causes the child to resist or minimize writing. Accordingly, the field of the present invention comtemplates a device that would be secured to a writing instrument to insure proper pressure against the writing surface.

2. Description of the Prior Art

It is of course well recognized that ease of writing and legible penmanship are desirable for written communication. As a result various efforts have been made in the past to improve penmanship by providing writing aids for proper gripping of a pen or pencil. For example, U.S. Pat. Nos. 1,416,564 and 2,498,105 provide devices that are employed with writing instruments to assist the writer in maintaining a predetermined proper angle of the writing instrument with the surface. U.S. Pat. No. 5,310,345 contemplates a writing aid that instructs the user in the proper location of his fingers in gripping the pen or pencil. These and other prior art patents all attempt to improve penmanship and instruct the writer in the optimum use of the writing instrument. However, none of these devices of the prior art are directed to the problem of maintaining appropriate pressure between the tip of the writing instrument and the writing surface, and it is to this problem that the present invention is directed.

SUMMARY OF THE INVENTION

The invention provides a device that permits normal writing by the user as long as proper pressure is applied to the writing implement. If excess pressure is applied then the writing aid operates to make further writing essentially impossible.

In particular, a sleeve is provided that surrounds the writing instrument and is gripped by the writer. The sleeve is held in position on the writing instrument with a predetermined force. Then if the writer presses the point of the instrument against the writing surface with a force in excess of the predetermined holding force, the sleeve that is gripped by the writer will slide relative to the writing instrument and thereby inform the writer that he is using excessive force. The displaced sleeve will essentially prevent him from further writing as long as he is exerting the excessive force.

Accordingly a primary object of the present invention is to provide a writing aid that prevents the writer from using excessive tip-to-surface force and informs him when such excessive force is applied.

It is a further object of the present invention to provide a writing aid device that is simple in construction and operation to insure proper pressure or force of the writing tip against the writing surface.

It is a still further object of the present invention to provide a writing aid that is secured to a writing instrument such as a writing pen or a pencil to alert the writer when he is applying excessive pressure while writing.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DESCRIPTION OF THE PREFERRED EMBODIMENT

Figure 1:
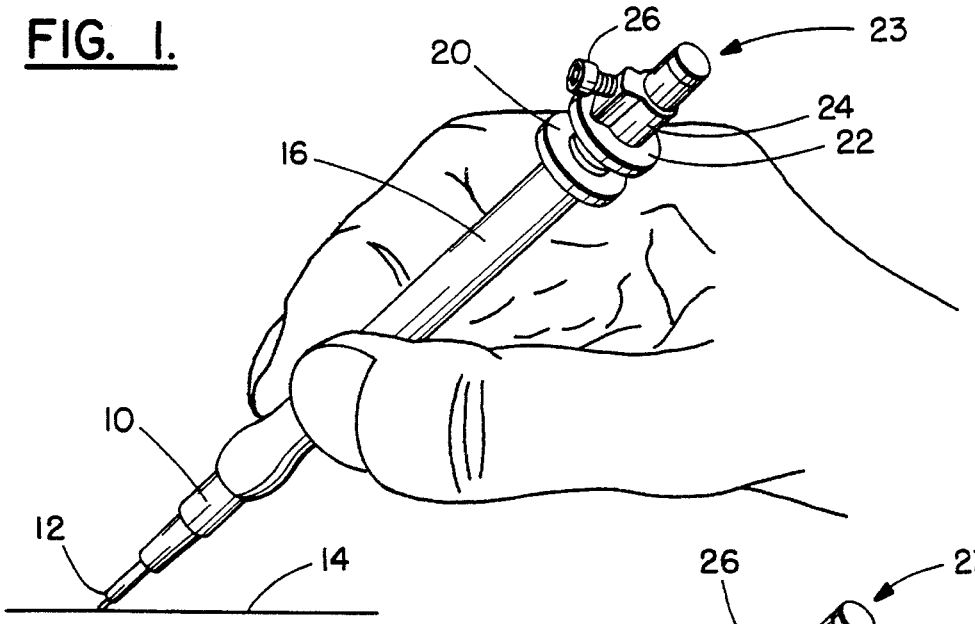
FIG. 1 is a perspective view of the writing aid of the present invention in normal use.

Referring now to the drawings and more particularly to FIG. 1, numeral 10 designates a writing instrument such as a pen or pencil having a writing tip 12 in contact with a writing surface 14.

It is understood that a writer will sometimes grip the writing instrument too tightly and press to heavily against the surface of the writing paper surface. Accordingly the present invention contemplates a sleeve 16 surrounding the writing instrument 10 in a fit that permits sliding axial movement between the sleeve and writing implement.

The upper end of sleeve 16 is threaded as at 18 and receives a magnetic disc 20. Another magnetic disc 22 is secured to the upper end of the writing instrument 10 as by a clamp 23 consisting of a collar 24 and screw 26. It is understood that magnet 22 may be secured to the writing instrument by any other convenient means.

The sleeve 16 has a protrusion 17 that encourages the user to hold the writing instrument comfortably at a distance from the writing surface selectable by means of the adjustable clamp 23.

Figure 2:
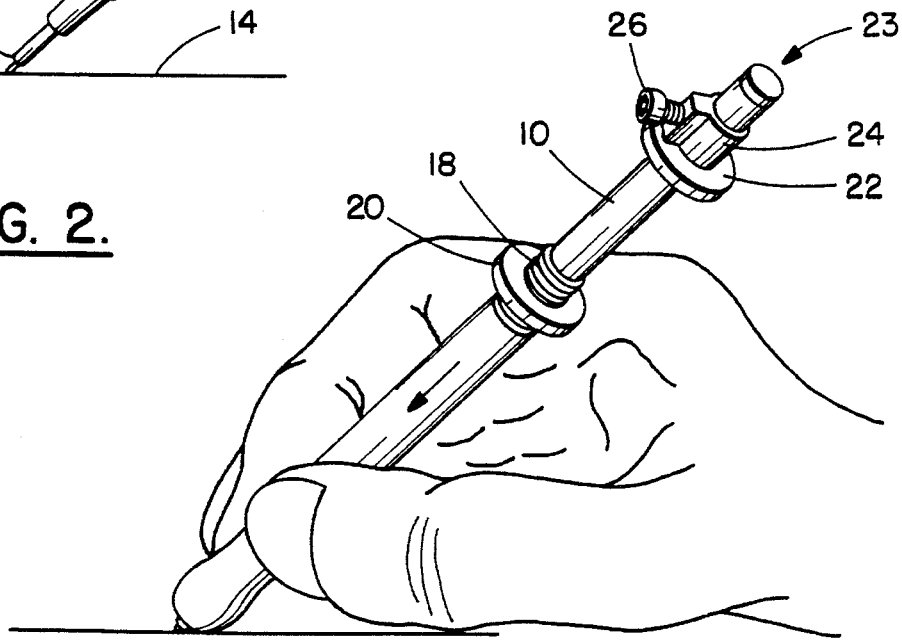
FIG. 2 is a perspective view of the invention in which excess pressure is being applied to the writing instrument.
Figure 3:
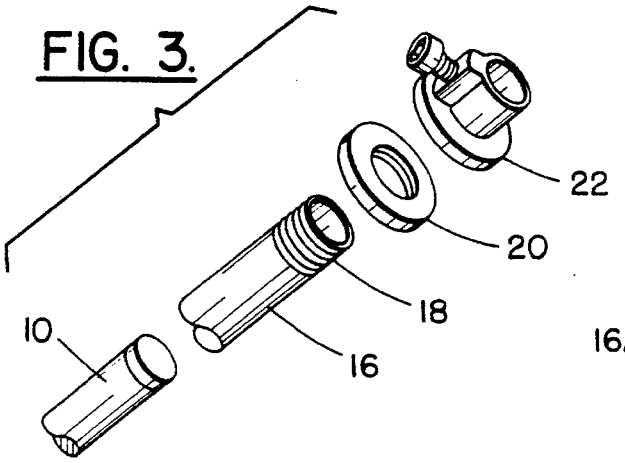
FIG. 3 is an exploded view of the writing aid.

As seen in FIG. 1 the magnetic discs 20 and 22 are separated by a small air gap and the magnets attraction between the discs will hold the sleeve 16 in position on the writing instrument with the upper end of the sleeve abutting against disc 22. The force of attraction between the magnets may be adjusted and predetermined in accordance with the proper downward pressure on the sleeve by the writer's hand and the engagement of the writing tip 12 with the writing surface 14. It is understood that if the writer presses against the surface with excessive force, the magnetic attraction of the discs 20, 22 will be exceeded and the sleeve 16 will slide downward on the writing instrument to the position as shown in FIG. 2. When this starts to occur the writer is immediately informed that he has exerted too much pressure against the writing surface and in addition it is difficult, if not impossible, for him to continue writing with the unit in the depressed or partially depressed position. The writer will then react and relax his pressure and the sleeve 16 will slide back to the position of FIG. 1 where the magnets 20, 22 will be in a position to provide sufficient attractive force to retain the sleeve in its proper position. The mounting of magnet 20 by the screw threads 18 permit adjustment of the air gap between the magnets. In turn, this affords an adjustability so that the attractive force of the magnets can be set to correspond to the appropriate pressure of the writing tip against the surface.

Although sleeve 16 is shown fully surrounding the writing instrument it is understood that it could be constructed to only partially surround it. It is only necessary that the sleeve be of sufficient circumference to remain on the writing instrument when in place.

The magnetic arrangement permits a system where there is a threshhold force at which the attraction of the magnet is overcome and the sleeve proceeds to slide down on the writing instrument. Disc's 20, 22 may be magnets or one may be a magnet and the other simply ferros or other magnetically responsive material.

The magnetic elements 20, 22 attract each other with an initial force that is a function of the air gap between them. However, a small movement of disc 20 that increases the air gap slightly will result in a considerable decrease in the attractive force. Thus, the force change is exponential providing a threshhold type response rather than gradual.

Excessive force results in an increase in the air gap and a resultant decrease in the magnetic attraction force at a rate that exceeds the rate of the users ability to respond to reduce excessive force and prevent the intended operation of the invention.

Thus, it is seen that as the gap slightly increases by the magnetic discs separating the attractive force will greatly decrease to permit the sleeve 16 to slide downward on the writing implement 10.

Figure 4:
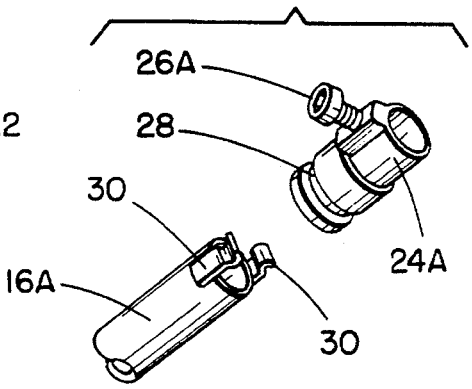
FIG. 4 is an exploded view of another embodiment of the present invention.

In the embodiment of FIG. 4 the collar 24A is extended and has a circular groove 28 that cooperates with a pair of spring clips 30 secured in any suitable manner to the upper end of sleeve 16A. With the spring clips in place in groove 28 the sleeve is retained in place on the writing instrument 10. Then when excess pressure is applied by the writer on the writing surface the clips 30 will bend outward and disengage from collar 24A permitting the sleeve 16A to slide downward on the writing instrument 10 to the position shown in FIG. 2. Thus the writer is informed that he is using excess force against the writing surface. He will then slide the sleeve upward to engage the spring clips with the groove 28. The spring clips 30 may be appropriately bent to provide the correct force in retaining the sleeve in position.

This adjustable feature corresponds to the air gap adjustment of the embodiment of FIG. 1.

Having thus described the invention with particular reference to the preferred forms thereof, it will be obvious that various changes and modifications may be made therein without departing from the spirit and scope of the invention as defined in the appended claims.

What is claimed is:

1. A writing aid to improve the penmanship of a person using an elongated writing instrument having a writing tip comprising;

first magnetic means;

means to secure the first magnetic means to the outer periphery of the writing instrument at a point distant from the writing instrument tip;

a sleeve surrounding the writing instrument between the first magnetic means and the writing instrument tip;

said sleeve being of a length in the direction of the first magnetic means at least extending beyond the hand of a person using the writing instrument in a normal writing grip;

a second magnetic means secured to the outer periphery of said sleeve at one end thereof to magnetically engage said first magnetic means with a predetermined attractive magnetic force;

adjusting means to adjust said predetermined attractive magnetic force;

said adjusting means comprising means to adjust the air gap between said first and second magnetic means; and said sleeve being axially movable with respect to the writing instrument whereby an axial force applied to the sleeve in excess of the predetermined attractive force will cause the first and second magnetic means to disengage and the sleeve to slide axially with respect to the writing instrument.

2. The writing aid set forth in claim 1 in which said sleeve has a protrusion around the circumference thereof at the end of the sleeve remote from the second magnetic means to provide a lower limit for holding the instrument.

* * * * *